United States Patent [19]

Cerioni

[11] 4,098,054

[45] Jul. 4, 1978

[54] DEVICE FOR FORWARDING SACKS OR LIKE CONTAINERS

[75] Inventor: Renzo Giuseppe Cerioni, Milan, Italy

[73] Assignee: EL CU S.p.A., Milan, Italy

[21] Appl. No.: 755,556

[22] Filed: Dec. 30, 1976

[30] Foreign Application Priority Data

Feb. 19, 1976 [IT] Italy ..... 20325 A/76

[51] Int. Cl.[2] ..... B65B 1/06; B65B 7/06

[52] U.S. Cl. ..... 53/139; 53/266 R; 53/371

[58] Field of Search ..... 53/371, 266, 373, 139, 53/268, 187, 188

[56] References Cited

U.S. PATENT DOCUMENTS

| | | | |
|---|---|---|---|
| 2,049,757 | 8/1936 | Baker et al. | 53/371 X |
| 2,097,447 | 11/1937 | Cundall et al. | 53/371 X |
| 3,896,605 | 7/1975 | Chevalier | 53/371 X |
| 3,945,173 | 3/1976 | Buzzi | 53/371 X |

*Primary Examiner*—Othell M. Simpson
*Assistant Examiner*—Horace M. Culver
*Attorney, Agent, or Firm*—Wenderoth, Lind & Ponack

[57] ABSTRACT

A device for forwarding sacks or like containers from a filling station to further processing stations includes a device for retaining the sack in its filling position, a conveyor for forwarding the filled sack, a device for lowering the filled sack down onto the conveyor, while simultaneously closing the sack mouth by seizing it from the outside and stretching out the edges thereof along a plane coincident with the forwarding direction of the sack, and a device for supporting and advancing the sack.

3 Claims, 5 Drawing Figures

DEVICE FOR FORWARDING SACKS OR LIKE CONTAINERS

BACKGROUND OF THE INVENTION

This invention relates to a device by which sacks or similar containers can be forwarded from a filling station to further processing stations, or to storage or to elsewhere, and more particularly, though not exclusively, to such a device suitable for handling sacks or like containers filled with usually pulverulent materials having a poor consistency and marked volatility features, and requiring therefore that the sack be kept in a vertical position, not only by a support at the bottom of the sack, but also by propping up the sack in the area of its filling opening. Such opening is to be sealed directly after the filling of the sack, and is to be maintained in such a sealed condition during the course of all subsequent operations, to thereby prevent a loss of material from the sack, as well as any possibility of pollution of the surrounding environment.

There are known systems by which one sack at a time is removed in a flattened condition from a stack of sacks, the removed sack is then automatically conveyed to a filling station, where the sack mouth is opened and slipped over a filling sleeve and retained thereagainst by suitable means, e.g. in the form of jaws acting from the exterior of the sack. Once the sack or like container is filled, it is transferred to a conveyor by which the sack is forwarded to subsequent processing stations, whereat, e.g., the sack edges are sewn, tags for the identification of the sack contents are applied, etc.

In the situation mentioned above, i.e. when the sacks are filled with particularly volatile materials, it is essential that the filled sack be transferred very slowly from the filling attachment or nozzle to the forwarding conveyor, and moreover that the sack mouth be immediately sealed and maintained in such sealed condition until the edges of the sack mouth are sewn, to prevent any loss of material and also to prevent any resultant pollution of the environment.

Such operations are heretofore performed manually, with a consequently high labour requirement, and also with the possibility of mistakes being made in performing the operation in the correct sequence.

SUMMARY OF THE INVENTION

Thus, the object of the present invention is to provide a device, having a particularly simple design and operating in a particularly reliable manner, which is able to automatically perform all of the above noted operations, while ensuring that the filled sack will be handled, from the filling station up to final mouth closing operation, e.g. sewing, without any, even small, loss of sack contents.

According to the present invention, the above objects are achieved by providing a device which comprises, in association with a filling station, with means for retaining the sack in its filling position, and with a conveyor for forwarding the filled sack, means for lowering the filled sack down onto the conveyor, while simultaneously closing the mouth of the sack, by grasping and stretching outwardly the edges of the sack along a plane coincident with the forwarding direction of the sack. The device also includes means for supporting and advancing the mouth of the sack during at least a portion of forwarding movement of the sack. In particular, the means for lowering the sack and closing the mouth thereof may advantageously include at least two pairs of seizing and supporting elements in the form of pressers, each presser pair being coaxially arranged. The presser pairs are controllably movable in directions to approach each other to thereby engage portions of the sack mouth. The sack mouth is then retained between the pressers, and the engaged portions are guided while the sack is lowered and the sack mouth is being closed. In more detail, portions of the sack outwardly of the jaws which retain the sack against the filling sleeve are acted upon by the pairs of pressers. Such portions extend along a diameter of the sack mouth directed parallel to the sack forwarding direction. The presser pairs are then synchronously moved along trajectories such that the sack is lowered onto the forwarding conveyor, while the presser pairs are simultaneously moved away from each other, in the direction of such diameter, thus bringing the edges of the sack mouth into mutual contact, i.e. closing the mouth of the sack.

As previously mentioned, after the sack is lowered onto the forwarding conveyor, the upper portion of the sack is engaged by supporting and advancing means independent of the pressers, and essentially including a pair of conveyors fitted on swinging arms. The conveyors can be moved together, in the manner of pliers, against the already closed sack mouth, before the forwarding motion of sack is started.

The device is operated by follow-up and control means, by which a suitable operating sequence of the movements of the various components is established, to ensure that the sack is always supported and guided without the danger of excessive stresses or breakage of the sack.

BRIEF DESCRIPTION OF THE DRAWINGS

A preferred embodiment of the invention will now be described in more detail, with reference to accompanying drawings, both the following description and drawings being exemplary only and not restrictive, and wherein.

DETAILED DESCRIPTION OF THE INVENTION

The device as shown is particularly, though not exclusively, designed to operate in cooperation with an already known system by which sacks are removed while flattened, one at a time, from a stack of sacks and are then automatically transferred to a filling unit, whereat the sack mouth is opened and slipped over a filling sleeve or nipple and fastened thereon.

In any case, the sack mouth is slipped over a filling sleeve 10 (see FIG. 1) extending from the bottom of a feeding hopper 12, and retained thereon by a pair of jaws 14, that are kept pressed against the sack walls until the end of the filling operation. Then the filled sack is lowered onto a forwarding conveyor 16, e.g. in the form of an endless band conveyor, by which the sack is conveyed to subsequent operating stations. As previously stated, when the materials being sacked have marked volatility features, it is most important that the filled sacks be lowered onto the band conveyor 16 as gently as possible, and that the mouth of the sack be closed as soon as it is removed from the filling sleeve 10.

Figure 3B:
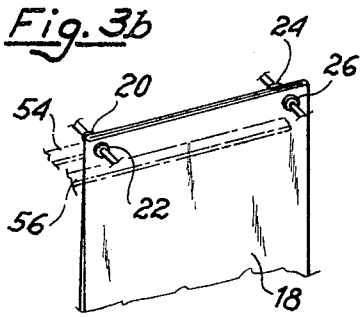
FIGS. 3*a* and 3*b* are perspective views showing two successive positions of a portion of a sack and of elements of the invention acting thereon.
Figure 3A:
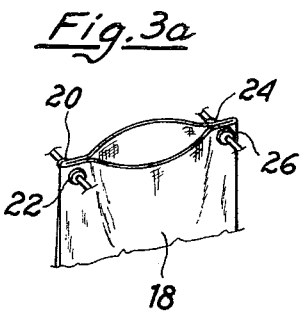
Figure 1:
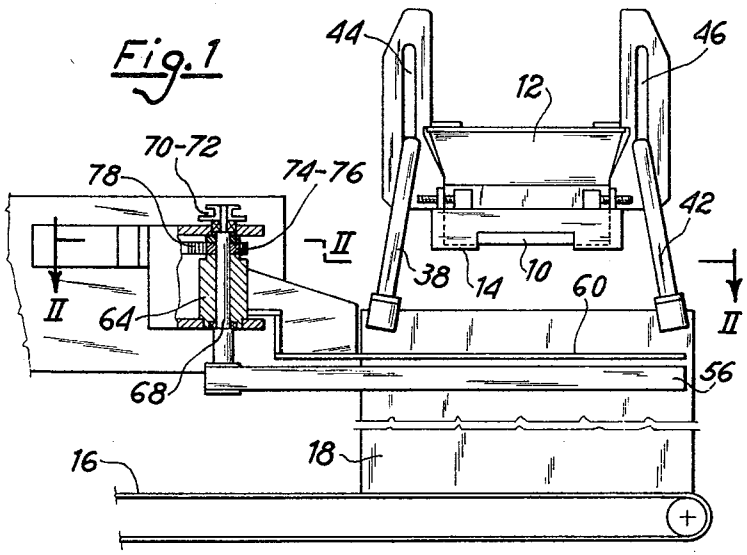
FIG. 1 is a schematic side view in partial section of a device according to the invention.
Figure 2:
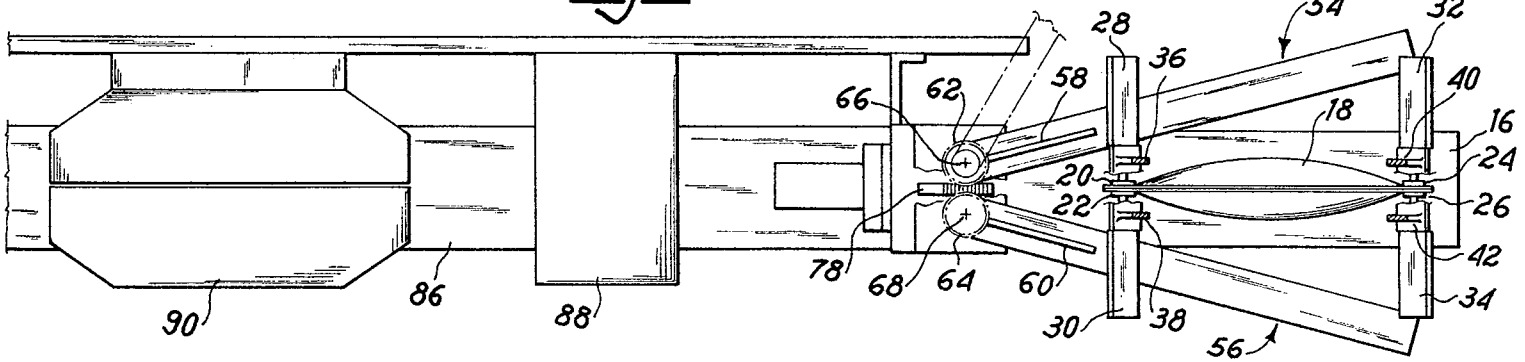
FIG. 2 is a schematic section of the device, taken along line II—II in FIG. 1, and also diagrammatically showing certain additional components that can be positioned downstream of the device of the invention.

The edges of sack mouth are engaged by the retaining jaws 14 against sleeve 10 over only a portion of the whole circumference of filling sleeve 10, thereby leaving free two lengths of sack mouth on opposite sides of filler 10, such lengths extending in a direction coincident with the forwarding direction of the sack. Therefore, such free lengths can be engaged by two pairs of seizing and supporting elements in the form of pressers 20, 22 and 24, 26. Each pair of pressers are axially aligned. Each presser is axially driven in a direction perpendicular to sack forwarding direction, e.g. by hydraulic or pneumatic cylinder-piston units 28, 30 and 32, 34. As shown in FIGS. 1, 2 and 3, the presser pair 20 and 22 is brought into engagement with the downstream portions of the sack mouth as viewed in the forwarding direction of the sack, while the presser pair 24 and 26 is brought into engagement with the upstream portions of the sack mouth. Pressers 20, 22, 24 and 26 are therefore operated by the respective units 28, 30, 32 and 34 in such a manner as to retain and support the mouth of the sack after it is filled, at a time when the sack mouth is still grasped by jaws 14. This position is shown in FIG. 3*a*, wherein the filler 10 and the jaws 14 are omitted for the sake of clarity.

The pressers 20, 22, 24 and 26, along with the respective driving units 28, 30, 32 and 34, are mounted on arms 36, 38, 40 and 42, respectively, that can be lowered by conventional mechanical means (not shown), to thereby lower the presser pairs 20, 22 and 24, 26, and the sack supported thereby, toward the conveyor band 16. Simultaneously, presser pair 20 and 22, units 28 and 30, and arms 36 and 38 are drawn apart from presser pair 24 and 26, units 32 and 34, and arms 40 and 42, until the opposite edges of the sack mouth are brought into positions of firm mutual contact, as shown in FIGS. 1, 2 and 3*b*. Such motion makes it possible to lower the sack 18, without any impact, down onto the conveyor 16, while simultaneously closing the sack mouth, as soon as the sack leaves the filler sleeve 10, to thereby prevent any loss of the sack contents. The above simultaneous dropping and diverging motion can be achieved by conventional mechanical motion control devices, e.g. suitably configured cam-shaped grooves 44 and 46 (see FIG. 1), within which move in a positively guided manner cam followers associated with arms 36, 38, 40 and 42. By suitably modifying the dimensional parameters of above components, e.g. by substitution of parts thereof, it is possible to adapt the motion of the presser pairs to particular sizes of handled sacks.

Figure 4:
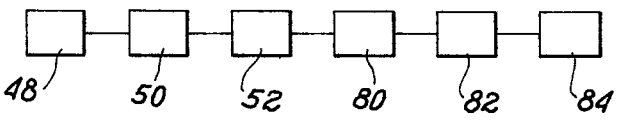
FIG. 4 is a block diagram showing the succession of operations that are performed on the sack by the device of the invention.

Obviously, the above described operations are to be performed in a suitable sequence, e.g. by follow-up and control means not shown, and as diagrammatically represented in FIG. 4, wherein the step of closing presser pairs 20, 22 and 24, 26 is indicated by reference number 48, the next step of opening jaws 14 is indicated by reference number 50, and the next step of providing the lowering and diverging motion of the presser pairs is indicated by reference number 52.

Once the sack 18 is lowered onto the forwarding conveyor 16, then conveyor 16 can be started. However, it is essential to maintain the sack mouth in the previously attained closed condition while also supporting the sack near its mouth. Provided for achieving such function according to the present invention are a pair of endless band conveyors 54 and 56 which operate in vertical planes and which are supported on arms 58 and 60, respectively, which swing about vertical axes. Thus, conveyors 54 and 56 can be closed, or moved together, after the manner of pliers, to grasp the sack 18 near the mouth thereof at a position below the presser pairs 20, 22 and 24, 26.

In more detail and with particular reference to FIGS. 1 and 2, the arms 58 and 60 are fitted on hollow supports 62 and 64, respectively. Supports 62 and 64 can be swung in either direction about shafts 66 and 68, respectively, which also support the driven pulleys of conveyor bands 54 and 56, respectively. Shafts 66 and 68 are driven by pulleys 70 and 72 in synchronization with one another and with the motion of forwarding band conveyor 16. The hollow supports 62 and 64 of arms 58 and 60, respectively are driven or pivoted by gears 74 and 76, respectively, in mesh with a rack 78.

Referring now to FIG. 4, the sequence of operations comprises, after the sack 18 is lowered onto conveyor 16, the step 80 of operating rack 78 to cause arms 58 and 60 to move together toward opposite sides of the mouth of sack 18, and due to the engagement of arms 58 and 60 with conveyors 54 and 56, causing conveyors 54 and 56 to swing together and grasp therebetween the sides of the mouth of sack 18, as shown in FIGS. 1 and 3*b*. Then, in the next step 82 the pressers 20, 22, 24 and 26 are opened and disengaged from the sack 18, and raised and returned to their respective initial positions, ready for engagement with the next sack. Then, in step 84, conveyors 16, 54 and 56 are advanced in synchronization.

Downstream of conveyor bands 54 and 56, the sack continues to be conveyed by three stationary bands, of which only the forwarding band acting as a prolongation of band 16 is indicated at 86 in FIG. 2. Thus, the conveyors 16 and 54, 56 are ready for engagement with the next sack, obviously after arms 58 and 60 are opened to allow for the passage therebetween of the next filled sack. As shown in FIG. 2, the sack 18 is conveyed to a station 88 where the sack mouth is sewn. The sack is then possibly conveyed to a station 90, where all air trapped in the sack is evacuated in a vacuum chamber through the sewing holes, and finally the sack may be conveyed to a station (not shown) where an identification tag is applied to the sack. These further stations are of known conventional type, whereby no further description thereof is made.

I will thus be appreciated that the device according to the invention, having an unusually simple and inexpensive design, makes it possible to automatically and reliably perform the operations of forwarding sacks or similar soft, or even hard, containers. On the other hand, the hereinbefore disclosed inventive concepts could obviously be placed into practice, with the same results, even by making many changes and modifications to the above specifically disclosed preferred embodiment, without departing from the spirit and scope of the invention, as defined in the appended claims.

What we claim is:

1. In a machine for filling material into the open mouth of a sack and then sewing shut the mouth of the sack, said machine being of the type including a fixedly positioned filling sleeve adapted to supply material into a sack, gripping jaw means for gripping central portions of the edges of an open mouth of a sack against said sleeve while the sack is in a filling position being filled with material supplied through said sleeve, such that first and second outer portions of the edges of the open mouth of the sack remain ungripped by said gripping jaw means and extend outwardly from opposite sides thereof, an intermittently operable belt conveyor means positioned beneath said sleeve for moving filled sacks away from said sleeve in a direction parallel to a plane extending through said outer portions, the upper surface of said belt conveyor means being spaced beneath the bottom of a sack being gripped by said gripping jaw means in said filling position, and sewing means positioned downstream of said sleeve with respect to the direction of movement of said belt conveyor means for sewing shut the mouths of the filled sacks, the improvement comprising:

first and second presser means, positioned adjacent said sleeve, for grasping respective first and second of said outer portions of the edges of the mouth of a sack held at the filling position thereof by said gripping jaw means, and for thereby supporting said sack;

said gripping jaw means being vertically immovable and operable to release said central portions of the edges of the mouth of said sack after said sack is filled with material supplied through said sleeve, whereby the thus filled sack is then supported by said presser means;

means for lowering said presser means and thereby said filled sack toward said belt conveyor means until the bottom of said filled sack rests on said upper surface of said belt conveyor means, and for simultaneously spreading said first and second presser means away from each other, thereby closing the open mouth of said filled sack;

first and second arms pivoted at first ends thereof about vertical axes;

first and second conveyor bands, one each supported by a respective said first and second arm, said first and second conveyor bands being pivotable at first ends thereof about said axes from respective inoperative positions spaced from each other and from said filled sack supported on said belt conveyor means by said presser means to respective operative positions toward each other and against opposite sides of said filled sack adjacent the mouth thereof at positions below said presser means supporting said sack;

means for pivoting said first and second arms about said axes and for thereby moving said first and second conveyor bands from said inoperative positions to said operative positions thereof and for thereby supporting said sack on said belt conveyor means;

said presser means being operable to release said filled sack, after said filled sack is supported by said first and second conveyor bands, and to move vertically upwardly to a position adjacent said sleeve; and said first and second conveyor bands being intermittently operable in synchronization with said belt conveyor means to move said filled sack away from a position beneath said sleeve in a direction toward said sewing means.

2. The improvement claimed in claim 1, wherein each of said first and second presser means comprises a pair of spaced pressers operated by a pair of coaxially aligned piston-cylinder units, such that said pair of pressers are movable toward and away from each other.

3. The improvement claimed in claim 1, wherein said pivoting means comprises a rack movable in a direction parallel to said direction, and first and second gears pivoted about said axes and fixedly connected to said first and second arms, respectively, said rack being in meshing engagement with said gears, such that movement of said rack causes rotation of said gears and thereby pivoting of said arms and said conveyor bands.

* * * * *